United States Patent [19]

Dahlen et al.

[11] Patent Number: 4,660,331

[45] Date of Patent: Apr. 28, 1987

[54] CONCRETE-FILLED STRUCTURAL TUBE WITH CANTILEVERS, PARTICULARLY FOR BALCONY FLOORS

[76] Inventors: Gustav L. Dahlen, Aerlestigen 1, S-70348 Oerebro; Nils A. Ryberg, Rösvägen 20, S-730 40 Kolbäck, both of Sweden

[21] Appl. No.: 681,868

[22] Filed: Nov. 28, 1984

[30] Foreign Application Priority Data

Apr. 8, 1983 [SE] Sweden ..... 8301953

[51] Int. Cl.[4] ..... E04B 2/56; E04B 1/38

[52] U.S. Cl. ..... 52/73; 52/283; 52/725

[58] Field of Search ..... 52/283, 73, 725

[56] References Cited

U.S. PATENT DOCUMENTS

| | | | |
|---|---|---|---|
| 1,432,192 | 10/1922 | Lally | 52/283 |
| 2,783,029 | 2/1957 | Fisher et al. | 52/283 |
| 3,832,811 | 9/1974 | Briel, Jr. | 52/73 |
| 4,137,576 | 2/1979 | Greene | 52/73 |
| 4,409,764 | 10/1983 | Wilnau | 52/725 |

FOREIGN PATENT DOCUMENTS

| | | | |
|---|---|---|---|
| 502297 | 4/1951 | Belgium | 52/283 |
| 2654807 | 6/1978 | Fed. Rep. of Germany | 52/73 |

*Primary Examiner*—John E. Murtagh
*Assistant Examiner*—Caroline D. Dennison
*Attorney, Agent, or Firm*—Young & Thompson

[57] ABSTRACT

A structural tube (10) with cantilevers (11) is provided with a plurality of openings (14) corresponding to the number of cantilevers. Each cantilever has at its fixing end an embedment means with at least one embedment arm (12A) extending into the respective opening in the tube and oriented substantially in the longitudinal direction of the tube. Concrete (16) is injected into the structural tube such that the embedment member or members of the embedment means are cast into the concrete, thereby to fix the cantilever to the structural tube.

1 Claim, 3 Drawing Figures

CONCRETE-FILLED STRUCTURAL TUBE WITH CANTILEVERS, PARTICULARLY FOR BALCONY FLOORS

The present invention relates to a structural tube with a plurality of cantilevers. The invention primarily relates to such tubes used as supports and placed along a building facade for carrying a plurality of balcony floors.

The tubular structures used up to now for carrying balcony floors comprise four steel tubes placed at the corners of the balcony which rests on joists between the verticals. Material and work costs for erecting such a structure are considerable.

The object of the present invention is therefore to provide a structural tube with cantilevers fixed to it in a simple and cheap manner. In this way there may be eliminated inter alia two of the vertical tubes in the known structures, resulting in a reduction of material, labor and transport costs.

In known structures of the kind mentioned, joists are attached to a vertical tube with the aid of welding or bolts. A careful and time-consuming welding operation is required to provide a welded joint having satisfactory strength properties. If the joint is to be made with bolts, the structure will generally be rather heavy while bolt fixing will be laborious.

Compared with the connections used so far between joists and vertical tubes, the invention signifies a considerable simplification with a reduction of both material and labour costs. In accordance with the invention, the cantilevers are provided at their fixing ends with a bracket or embedment in concrete and having at least one member substantially at right angles to the cantilever. This member is inserted in an opening in the structural tube, the cantilever then being stabilized in its predetermined position. Concrete is then injected into the structural tube to fill it in and simultaneously fix the previously mentioned member. When the concrete has set there is obtained a connection so strong that the cantilever may be used for supporting a balcony floor in association with a cantilever on a second structural tube placed at a predetermined distance parallel to the first structural tube along a building facade.

In a preferred embodiment of the invention, the cantilevers are also tubular. The member cast into concrete is then extended with an interior portion inside the cantilever for being cast into the concrete which is forced out into the cantilever when concrete is injected into the structural tube.

By injecting concrete into the structural tube and possibly also into the cantilevers there is obtained a considerable reinforcement of the tubes, in turn signifying that thinner wall thicknesses may be used with a consequent reduction in material costs. By the tubes not being so heavy, they can also be handled more comfortably before the concrete is injected.

Fixing the structural tubes to a building facade in in their vertical positions is done with bolts fastened to the concrete floors of the building and does not involve any notable difficulties. Handling can be carried out with the aid of conventional means such as side cranes, mobile cranes and the like.

The structural tube with its cantilevers in accordance with the invention is particularly suitable for use when it is desired to replace damaged balcony floors with new ones, but can also be used for providing balconies on facades which are not already provided with them. The inventive components can naturally be used to advantage in the construction of new houses which are to be provided with balconies.

Figure 1:
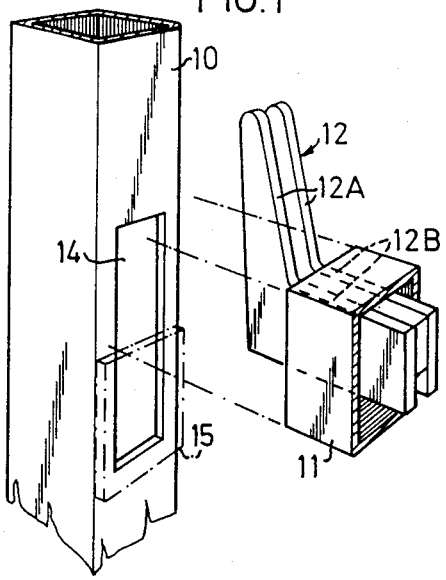
FIG. 1 is a schematic exploded perspective view of a portion of a structural tube with a cantilever and embedment means before being fixed to the structural tube.
Figure 2:
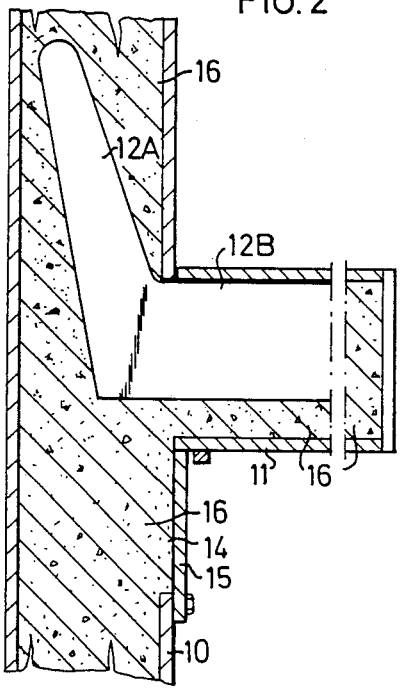
FIG. 2 is a section through the structural tube together with a cantilever fixed with the aid of the embedment means being cast in the concrete injected into the structural tube and also into the tubular cantilever.
Figure 3:
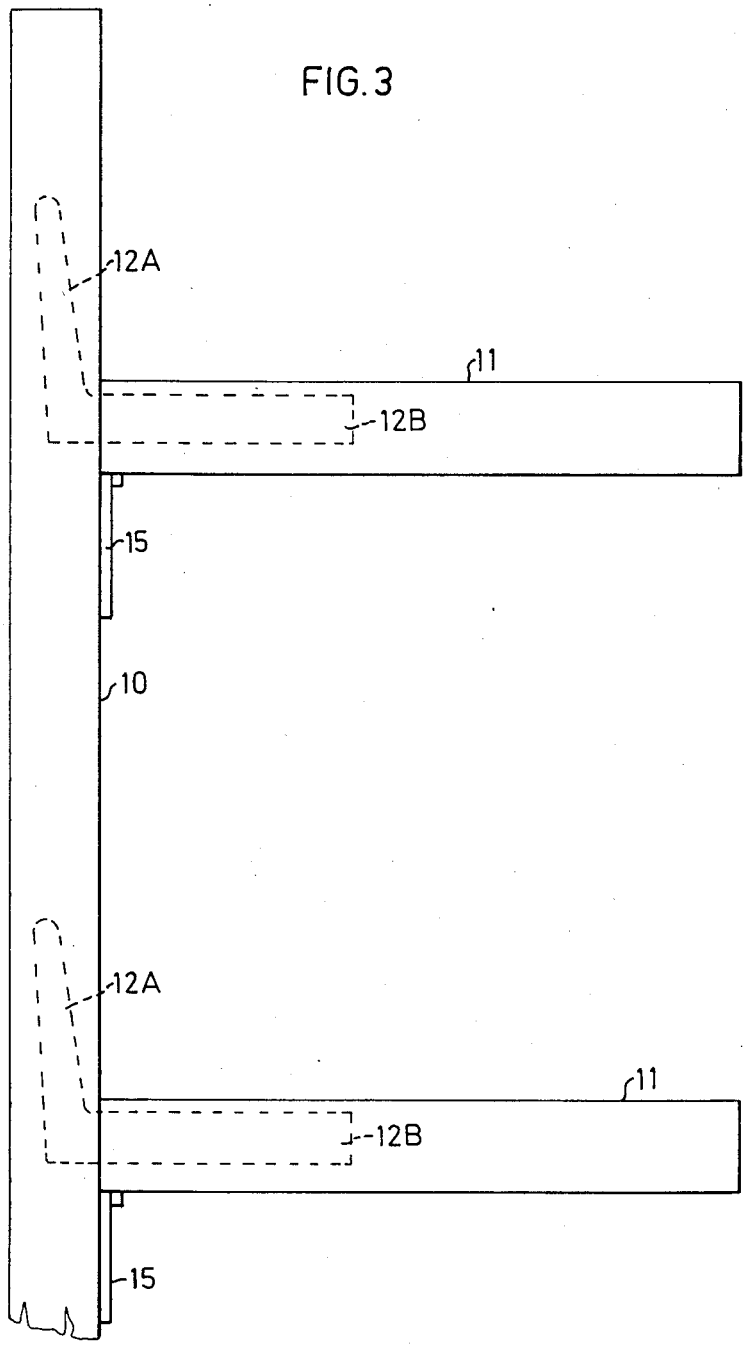
FIG. 3 is a schematic side view of a structural tube with a plurality of cantilevers in accordance with the invention.

The quadratic structural tube 10 illustrated in the figures is made from steel and is intended for erecting in a vertical position along a building facade for carrying a plurality of horizontal cantilevers 11, these being of tubular steel in the illustrated example. At its fixing end, each cantilever has an embedment means 12 in the form of one or more embedment members 12A extending substantially a right angles to the cantilever for assuming the position inside the structural tube illustrated in FIG. 2 after having been passed through an opening 14 in the structural tube, the members 12A then assuming an extension substantially in register with the longitudinal direction of the structural tube. Each member 12A is provided with a portion 12B extending into the cantilever 11. As can be seen from FIG. 1, the members 12A, 12B are plate-like members lying in a vertical plane.

After insertion of the embedment members into the structural tube, the opening 14 is covered with the aid of a plate 15 below the cantilever so that the opening 14 will be sealed with the aid of the end of the cantilever and plate. As will be seen from the figures, the interior of the cantilever will still be in communication with the interior of the structural tube.

When the structural tube, cantilever and the embedment members 12A,12B are assembled in the position shown, concrete 16 is injected at the lower end of the structural tube. The upper end of the tube is closed off excepting an air vent which is plugged after the tube has been filled with concrete. During injection, concrete will be forced out to fill the cavities of the cantilevers. At the free ends of the latter there is an air vent which is closed off when the cantilever is filled with concrete.

The embedment members of the embedment means will thus be embedded in concrete in both structural tube and cantilever, resulting in that when the concrete has set and expanded, usually after about 48 hours, the embedment means is solidly cast into the concrete in the structural tube and cantilever tube. A reliable fixing between the structural tube and cantilever has thus been provided in a simple, cheap and rapid manner. By filling the structural tube and cantilever tube with expanding concrete, there has also been achieved substantial reinforcement of these tubes, consequently enabling both tubes to be made with less wall thickness than what would otherwise have been required if they had not been reinforced by the concrete. The use of expanding concrete in the structural tubes and the tubular cantilevers results in optimum friction between the concrete core and the surrounding tube, thus increasing strength and preventing internal corrosion of the tube, this being a serious problem in tubular structures of the kind in question used so far.

A pair of such structural tubes and their cantilevers can be erected using simple means at given spacing along a building facade such that pairs of associated cantilevers may be utilized for supporting balcony floors. The erection of structural tubes and their cantilevers may take place entirely from the exterior of a building without disturbing any activities inside it.

The invention is not limited to the illustrated embodiment. The cantilevers do not need to be made from tubes, but each can consist of a solid steel arm extended at its fixing end with at least one embedment arm 12A, which is then made so that it seals the opening in the structural tube together with the plate sealing the opening below the arm. This embodiment thus enables the same simple fixing of the cantilever to the structural tube with the aid of the concrete injected into the tube, the concrete being cast round the arm in this case as well.

I claim:

1. A steel structural tube with a plurality of steel cantilevers, characterized in that the structural tube (10) has a pluralaity of vertically spaced openings (14) in a vertical side wall thereof corresponding to the number of cantilevers (11), in that each cantilever has at its fixing end an embedment means in the form of a plate-like member lying in a vertical plane with at least one embedment arm (12A) extending into the opening in the structural tube such as to lie inside it and substantially in its longitudinal direction, in that the structural tube is filled with injected concrete (6) in which the embedment arm is cast, thereby fixing the cantilever to the tube, in that the cantilever (11) comprises a tube closed off at its free end and with its fixing end sealing about the opening in the structural tube, the structural tube and cantilever tube having respective cavities that are in communication, in that the respective embedment arm is extended with a portion (12B) extending into the cantilever, and in that the cantilever is filled with injected concrete (16) which has been forced out into the cantilever on injecting concrete into the structural tube such that the extended portion (12B) of the arm will be cast into the concrete.

* * * * *